US005146992A

United States Patent [19]

Baugh

[11] Patent Number: 5,146,992

[45] Date of Patent: Sep. 15, 1992

[54] PUMP-THROUGH PRESSURE SEAT FOR USE IN A WELLBORE

[75] Inventor: John L. Baugh, Houston, Tex.

[73] Assignee: Baker Hughes Incorporated, Houston, Tex.

[21] Appl. No.: 742,399

[22] Filed: Aug. 8, 1991

[51] Int. Cl.[5] ..... E21B 43/00; E21B 23/00

[52] U.S. Cl. ..... 166/383; 166/154; 166/316; 166/382

[58] Field of Search ..... 166/381-383, 166/386, 387, 179, 191, 192, 195, 196, 154, 156, 316-318

[56] References Cited

U.S. PATENT DOCUMENTS 4,583,593 4/1986 Zunkel et al. ..... 166/382
4,589,495 5/1986 Langer et al. ..... 166/156
4,828,037 5/1989 Lindsey et al. ..... 166/317
4,862,966 9/1989 Lindsey et al. ..... 166/382

*Primary Examiner*—Thuy M. Bui
*Attorney, Agent, or Firm*—Melvin A. Hunn

[57] ABSTRACT

A seal assembly is provided for use in a fluid flow conduit, and includes a valve seat and a valve plug. The valve seat includes a seating lip formed at least in-part of yieldable material. The valve plug is passed through the fluid flow conduit and caused to sealingly engage the valve seat. Together the valve seat and valve plug form an obstruction to the passage of fluid within the fluid flow conduit, and pressure is developed upstream. At a predetermined pressure level the valve deforms the valve seat, and is passed therethrough. A larger valve plug can be passed until it seats against the enlarged valve seat. The pass-through process can be repeated.

36 Claims, 5 Drawing Sheets

FIG. 5
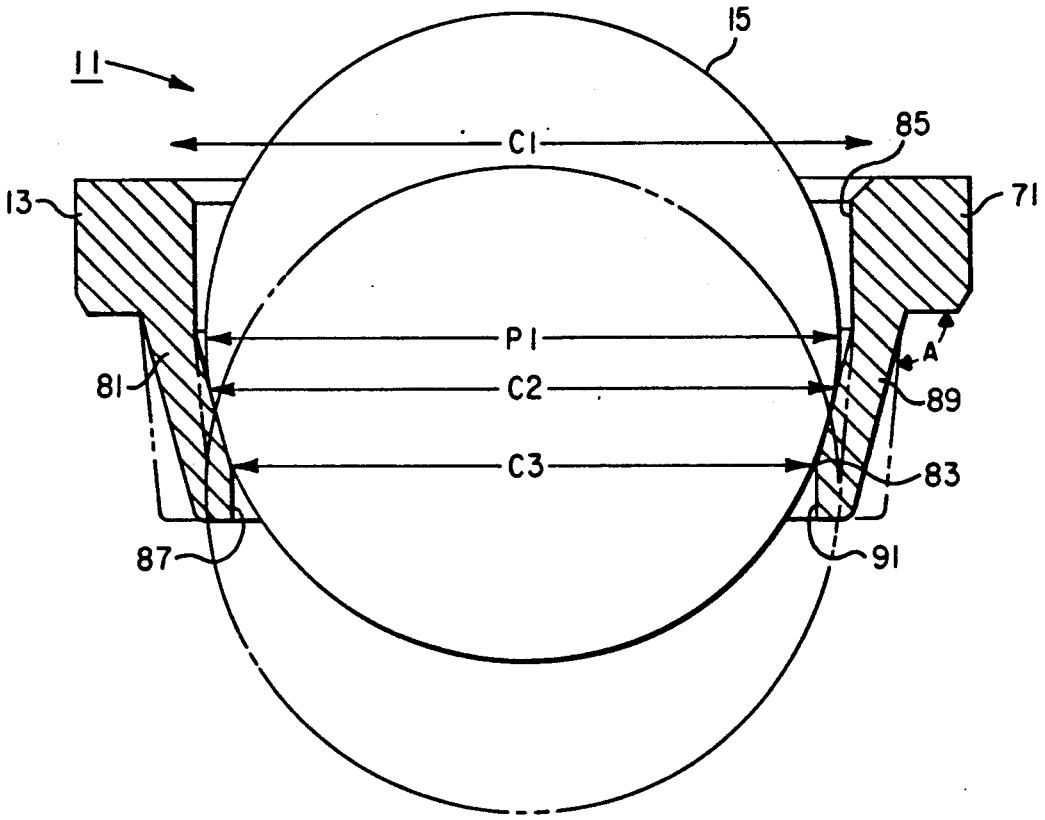
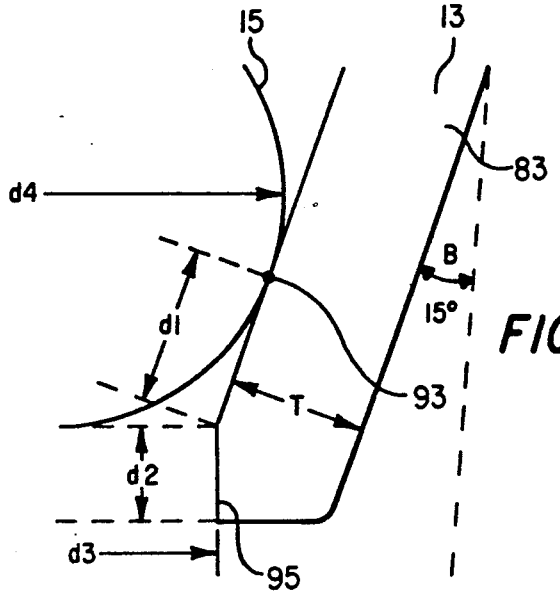
FIG. 6

PUMP-THROUGH PRESSURE SEAT FOR USE IN A WELLBORE

BACKGROUND OF THE INVENTION

1. Field of the Invention

The present invention relates generally to seals for use in wellbores, and specifically to seals which include a plug member which sealingly engages a seat member to form a seal within a wellbore.

2. Description of the Prior Art

In the drilling, completion, and production of oil and gas wells, concentrically nested wellbore tubular members, such as casing, tubing, workstrings, and the like, define fluid flow paths. For business and engineering reasons, it is not uncommon for one or more wellbore fluid flow paths to be at least temporarily obstructed by the positioning of one or more valve plugs within the fluid path, which seat with valve seats disposed within the fluid flow path.

Commonly, shearable connectors, such as shear pins, are used in combination with the wellbore plug and valve seat to render a purposeful obstruction of a fluid flow path reversible. In practice, the wellbore plug sealingly engages the valve seat over a range of operating pressures. When a predetermined fluid pressure threshold is exceeded, shearable connectors are sheared, opening fluid paths around the combination of the wellbore plug and valve seat. Of course, this technique requires that the wellbore tubular member is equipped with ports or other fluid flow paths, which are expensive to design and manufacture, which present unacceptable risks of failure, and which can become clogged with debris carried in the wellbore fluids.

Prior art plug-and-seat valves present an additional problem. Frequently, the plug and seat assembly remain mated together, preventing the passage of wireline tools, workstrings, or coiled tubing through the wellbore tubular member. Of course, wireline tools and workstrings are now widely used for a number of wellbore operations, so obstruction by the plug-and-seat valve presents a serious impediment to standard wellbore operations.

SUMMARY OF THE INVENTION

It is one objective of the present invention to provide a valve seat which is adapted for receiving, and temporarily sealingly engaging, a valve plug which is positionable within the wellbore, which includes a sealing lip which is adapted for sealingly engaging the valve plug, and for substantially occluding the passage of fluid from an upstream location to a downstream location, wherein a pressure differential developed across the valve seat and plug operates to deform the sealing lip and allow passage of the valve plug downstream within the fluid conduit, when a predetermined amount of force is applied thereto.

It is another objective of the present invention to provide a seal means for use in a wellbore tubular member, which includes a plug member positionable within the tubular member, and seat disposed within the bore and coupled to the tubular member, wherein the seat member and plug member cooperate together to substantially occlude the bore of the wellbore tubular member and impede passage of wellbore fluids through the bore, until a predetermined pressure differential is developed across the valve seat, causing the plug member to expand a yieldable region of the seat member and pass therethrough.

It is yet another objective of the present invention to provide a seal means which includes a plurality of plug members, positionable within a wellbore tubular member, and a seat member disposed within a wellbore tubular member which includes a seating surface for receiving selected ones of the plurality of plug members, wherein the seal means is operable in a plurality of modes including a receiving mode of operation for seating selected ones of the plurality of plug members, a sealing mode of operation wherein the seat members mates with selected ones of the plurality of plug members, and a releasing mode of operation wherein a yieldable material of the seating surface deforms in response to elevation of pressure above a predetermined release pressure level, allowing passage of previously-seated plug members.

These objectives are achieved as is now described. A seal means is provided for use in a wellbore tubular member disposed in a subterranean well. The wellbore tubular member has a bore which serves as a conduit for passing wellbore fluids of a predetermined specific gravity. The seal means includes a number of elements. A plurality of plug members are provided, each having a selected specific gravity relative to the specific gravity of the wellbore fluids, for passage within the wellbore through the wellbore fluid. Each of the plurality of plug members has a selected plugging dimension which differs from the plugging dimension of others of the plurality of plug members.

A seat member is provided and disposed within the bore of the wellbore tubular member, and includes a seating surface means for receiving selected ones of the plurality of plug members, and defining an exhaust passage through the seat member. The seating surface means is composed of a yieldable material, and defines a sealing dimension.

The seat member is operable in a plurality of modes. In a receiving mode of operation, the seating member allows passage of selected ones of the plurality of plug members which have a plugging dimension. The seating members presents passage of others of the plurality of plug members which have a plugging dimension equal to or greater than the seating dimension of the seating surface means.

In a sealing mode of operation, the seat member mates with a selected one of the plurality of plug members which has a plugging dimension equal to or greater than the seating dimension. The plug member sealingly engages the seating surface to substantially occlude the bore of the wellbore tubular member to obstruct passage of fluid therethrough, creating a pressure differential across the seat member.

In a releasing mode of operation, the yieldable material of the seating surface means deforms in response to elevation of the pressure differential above a predetermined release pressure level. As a result, the seating dimension of the seating surface is altered, allowing the selected one of the plurality of plug members to pass through the exhaust passage.

Successive operation in receiving, sealing, and releasing modes of operation for the plurality of plug members causes successive deformation of the seating surface means and alters the seating dimension, allowing the seat member to successively and selectively mate with selected ones of the plurality of plug members.

Preferably, the plurality of plug members comprise a plurality of sphere-shaped plugs formed of material having a specific gravity greater than the specific gravity of the wellbore fluids which allow the plurality of sphere-shaped plugs to be dropped within the wellbore tubular member. Also, in the preferred embodiment, the seat member includes a seating surface which comprises a circular seating surface with a sealing lip formed of yieldable material which is disposed radially inward a selected distance from the wellbore tubular member, and which radially bounds and defines a central exhaust passage.

The above as well as additional objects, features, and advantages of the invention will become apparent in the following detailed description.

BRIEF DESCRIPTION OF THE DRAWING

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

FIG. 5 is a cross-section view of the preferred wellbore seat shown in two positions, with a wellbore plug shown in phantom;

FIG. 6 is a simplified partial cross-section view of a portion of the valve seat of the present invention engaging a valve plug, and the relative dimensions established during sealing;

DETAILED DESCRIPTION OF THE INVENTION

Figure 1:
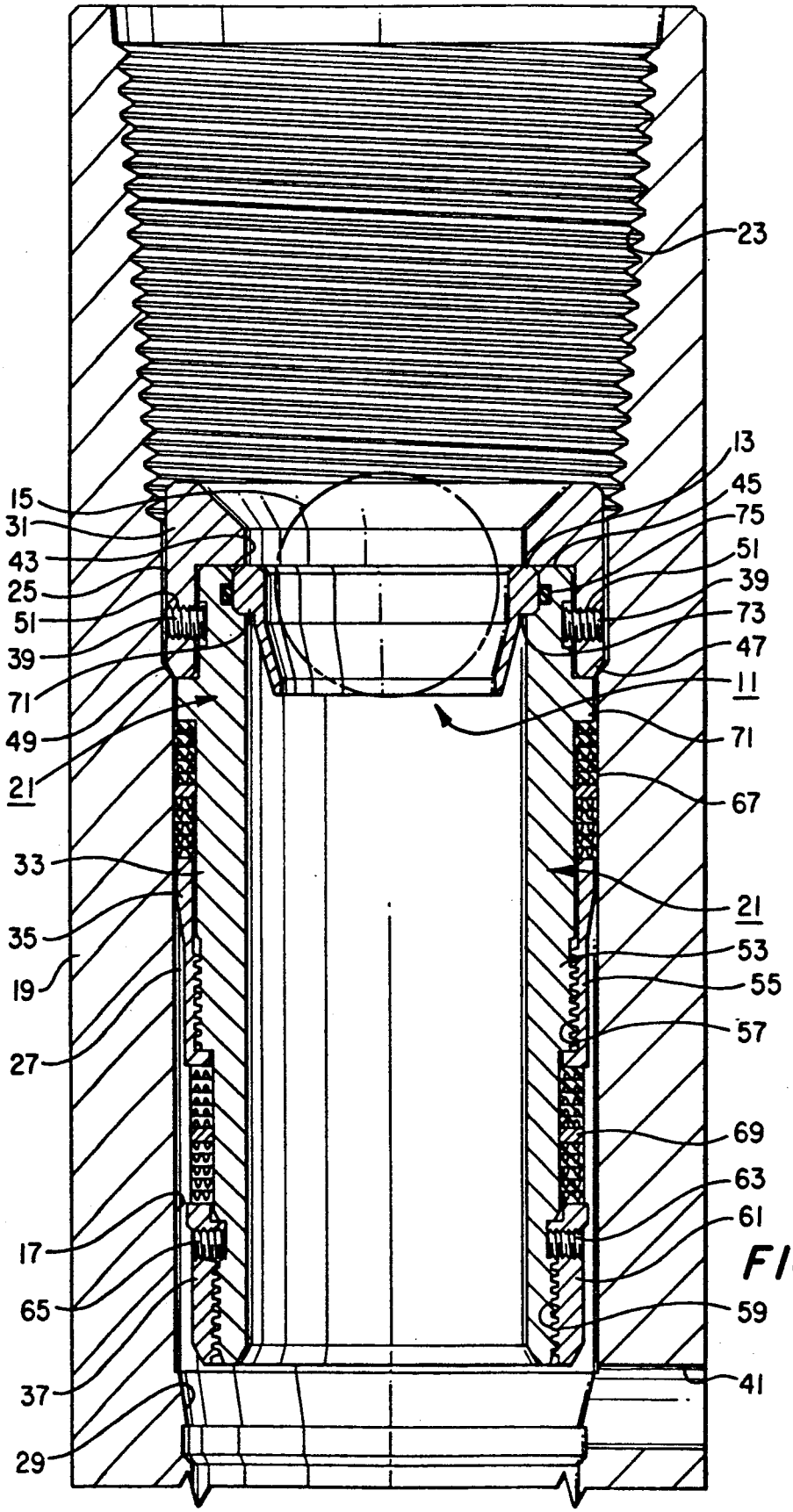
FIG. 1 is a longitudinal section view of one preferred embodiment of the seal means of the present invention in use in one particular application of the seal means to close a wellbore port.

FIG. 1 is a longitudinal section view of one preferred embodiment of the seal means of the present invention, in use in one particular application to close a wellbore port. As shown, seal assembly 11 includes valve seat 13, and valve plug 15, which cooperate together to at least temporarily occlude central bore 17 of wellbore tubular member 19. Seat assembly 21 is adapted to carry valve seat 13 concentrically within central bore 17 of wellbore tubular member 19. As shown, seat assembly 21 is positioned within internally-threaded box end 23 of wellbore tubular member 19. Central bore 17 includes three regions of differing radial dimension, including upper region 25, middle region 27, and lower region 29. As shown, upper region 25 has a slightly larger diameter than middle region 27. Middle region 27 has a slightly larger diameter than lower region 29.

Seat assembly 21 includes a number of components which cooperate together to selectively seal port 41 which allows for the communication of fluid between the interior and exterior of wellbore tubular member 19. As shown in FIG. 1, port 41 is maintained in a normally-open position, but will be closed when valve plug 15 sealingly engages valve seat 13, and causes seat assembly 21 to detach seal mandrel 33 from upper retainer ring 31 by shearing shearable connectors 39. When shearable connectors 39 are sheared seal mandrel 33 will move downward relative to stationary upper retainer ring 31, and block the passage of fluid through port 41.

Stationary upper retaining ring 31 is circular in shape, defining a central circular passage 43, and includes upper and lower shoulders 45, 47. Upper shoulder is adapted to receive the upper end of seal mandrel 33, and lower shoulder 47 is adapted to engage shoulder 49 at the transition between upper region 25 and middle region 27 of wellbore tubular member 19. Upper retainer ring 31 also includes connector ports 51 which are adapted to receive shearable connectors 39.

As is well known in the art, the pressure level which must be obtained to release seal mandrel 33 from upper retainer ring 31 is established by the cumulative shear strength of shearable connectors 39. The total force required is a function of the number of shearable connectors provided, the materials selected to form shearable connectors 39, and the cross-sectional area of each shearable connector 39. The design criteria and choices needed to select a shear threshold are conventional, and well known in the art. By making these design choices, one can establish a force level which must be exceeded in order to separate seal mandrel 33 from upper retainer ring 31.

In the preferred embodiment, seal mandrel 33 includes a number of components which cooperate together to allow seal mandrel 33 to close port 41. Specifically, mandrel 53 includes external threads 57, 59 for coupling with taper lock ring 55, and lower retainer ring 61 respectively. Lower retainer ring 61 is additionally secured to mandrel 53 with set screws 63, 65.

Cylindrical packing spacer 67 is disposed about mandrel 53 between shoulder 71 of mandrel 53, and taper lock ring 55. Likewise, packing spacer 69 is radially disposed about mandrel 53 between taper lock ring 55 and lower retaining ring 61. Preferably, seal mandrel 33 includes an outer contour which is adapted to conform to central bore 17 of wellbore tubular member 19, and specifically to the contour of middle region 27, and lower region 29. With such a contour, seal mandrel 33 can be wedged in position within wellbore tubular member 19, and form a fluid-tight seal to prevent the passage of fluid through port 41 which extends through wellbore tubular member 19.

Seal assembly 11 is carried concentrically with mandrel 53. Valve seat 13 includes shoulder 71 which mates with shoulder 73 of mandrel 53. O-ring seal 75 is provided at the interface of mandrel 53 and valve seat 13, to prevent the passage of fluid therebetween.

Seal assembly 11 is perhaps better described with reference to FIG. 5. As shown, seal assembly 11 includes valve seat 13, and valve plug 15. Preferably, valve plug 15 comprise a sphere-shaped plug formed of a material having a specific gravity which differs from the specific gravity of the wellbore fluid which carries the plug. For example, valve plug 15 can be formed of steel or other material which has specific gravity far greater than that of the specific gravity of the drilling, completion, or production fluids of the wellbore. Alternately, valve plug 15 can be formed of a material which has a specific gravity which is substantially less than that of the wellbore fluid. With the specific gravity greater than that of the wellbore fluid, valve plug 15 will be carried downward within the wellbore by force of gravity. With specific gravity less than that of the wellbore fluid, valve plug 15 will be carried upward within the wellbore fluid.

Valve seat 13 includes shoulder 71 for mating with a reciprocally-shaped shoulder in seal mandrel 33, as discussed above. Preferably, shoulder 71 is part of a cylindrical-shaped piece which abuts the interior of mandrel 53 of seal mandrel 33. Also, preferably, sealing lip 83 is integrally formed with shoulder 71, and extends downwardly from shoulder 71 and radially inward. The first, upper end 85 of valve seat 13 defines a circular clearance having a diameter of C1. Sealing lip defines a second, lower end 87 which defines a second circular clearance having a diameter of C2. In the preferred embodiment, clearance C1 is adapted to be greater than the plugging dimension P1 of valve plug 15. Additionally, second clearance C2 is adapted to define a clearance which is less than the plugging dimension P1 of valve plug 15. Therefore, as valve 15 is directed from an upstream position through first, upper end 85 of valve seat 13, it is unable to pass through valve seat 13, since second clearance C2 is smaller than the plugging dimension P1 of valve plug 15. Accordingly, valve plug 15 seats against valve seat 13 at sealing lip 83, and forms a seal therewith. If, as in the preferred embodiment, valve plug 15 is a spherical-shaped plug, it will form a seal at a circular line at the interface with sealing lip 83.

In the preferred embodiment, valve seat 13 is formed at least in-part of a yieldable material 89. In the preferred embodiment, valve seat 13 is formed of 6061-T6 aluminum. Also, in the preferred embodiment, anchor section 81, which includes sealing lip 83 is disposed at an angle which is fifteen degrees from normal. Therefore, the angle "A" is 105° as shown in FIG. 5. The inner surface and outer surfaces of anchor section 81 are substantially parallel, so sealing lip 83 is inclined 15° (which is established by the central bore 43 of mandrel 53).

When valve plug 15 sealingly engages valve seat 13, a pressure differential is developed across valve seat 13 between upper and lower ends 85, 87, and applies force to sealing lip 83. Valve seat 13 is adapted to maintain its position until a predetermined pressure differential is developed across valve seat 13. When the predetermined pressure differential is developed, sealing lip 83 deforms to expand second clearance C2 to the plugging dimension P1 of valve plug 15 to allow passage of the valve plug 15 downstream within the fluid conduit. Consequently, sealing lip 83 of valve seat 13 is permanently deformed to a second position (which is shown in phantom in FIG. 5) to define a third clearance C3 which is substantially identical to the plugging dimension P1 of valve plug 15. Preferably, the third clearance C3 is intermediate in diameter of the first and second clearances C1, C2. As shown in FIG. 5, passage of valve plug 15 through valve seat 13 also alters the angular disposition of sealing lip 83 relative to wellbore tubular member 19 and seal mandrel 33 by decreasing the angle of inclination with respect to wellbore tabular member 19.

When in the second position having clearance C3, valve seat 13 is adapted for receipt of another valve plug 15, which has a plugging dimension which exceeds the plugging dimension P1 of the previous valve plug 15. Therefore, valve seat 13 may successively and sequentially engage increasingly larger valve plugs, each of which are disengaged from valve seat 13 when a predetermined pressure differential is developed across valve seat 13. This incremental increase in the clearance defined by sealing lip 83 can continue up the yield limits of the material which forms sealing lip 83. In the preferred embodiment, when 6061-T6 aluminum is used to form valve seat 13, the material has an inherent ability to yield up to 15%. Preferably, however, sealing lip 83 is expanded only up to a maximum of only 6 to 8% of yield.

At present, the requisite pressure differential which must be developed across valve seat 13 in order to expel valve plug 15 can only be determined empirically by successive and sequential testing of valve seats 13 which have particular known dimensions. FIG. 6 is a simplified fragmentary cross-section view of valve seat 13 which sealingly engages valve plug 15 at seal point 93. As discussed above, sealing lip 83 is disposed at an angle (angle B) which is 15° from normal, wherein normal is defined by the central bore 17 of wellbore tubular member 19. As shown, sealing lip 83 has a thickness of T inches. Futhermore, sealing lip 83 terminates at a straight away region 95 which has a length of d2 inches, and defines a circular clearance with a diameter of d3 inches. The distance between seal point 93 and the beginning of straight away region 95 is a distance of d1 inches. Of course, the location of seal point 93 is established by the plugging dimension d4 of valve plug 15, which is the diameter of plug 15. Of course, the plugging dimension d4 of plug 15 will always be slightly larger than the diameter d3 of the seat.

The following table includes data which has been developed empirically through laboratory testing of seal assemblies of the present invention. All testing was done on valve seats which were formed from 6061-T6 aluminum, within an inherent yield capability of 15%.

| | T inches | d1 inches | d2 inches | d3 inches | d4 inches | PSI For Pump Through |
|---|---|---|---|---|---|---|
| 1. | 0.093 | 0.280 | 0.187 | 2.31 | 2.5 | 800 PSI |
| 2. | 0.135 | 0.280 | 0.187 | 2.31 | 2.5 | 1690 PSI |
| 3. | 0.188 | 0.280 | 0.250 | 2.31 | 2.5 | 2200 PSI |
| 4. | 0.219 | 0.200 | 0.125 | 1.59 | 1.75 | 3475 PSI |
| 5. | 0.219 | 0.200 | 0.125 | 1.62 | 1.75 | 3035 PSI |

Returning now to FIG. 1, the operation of seat assembly 11 will now be described. As shown, valve plug 15 is dropped within wellbore tubular member 19, and comes to rest within valve seat 13 and sealingly engages sealing lip 83 of valve seat 13, substantially occluding wellbore tubular member 19, and preventing the passage of fluid from an upstream location to a downstream location. Consequently, pressure will develop upstream of valve plug 15, as wellbore fluid is continually pumped downward within central bore 17.

At a predetermined first pressure differential level, shearable connectors 39 will shear, and seal mandrel 33 will move downward within wellbore tubular member 19 relative to upper retainer ring 31 which remains stationary. Since the outer surface of seal mandrel 33 is contoured to mate with central bore 17, seal mandrel 33 will become wedged in position, and obstruct the passage of fluid through port 41.

At a higher, second predetermined pressure differential, say for example 800 psi, valve plug 15 will deform sealing lip 83 by urging it radially outward toward wellbore tubular member 19, until valve plug 15 can pass therethrough.

As a consequence, port 41 is now in a closed position, but wellbore tubular member 19 does not remain obstructed by valve plug 15. Rather, valve plug 15 drops to the bottom of the wellbore, tubular member 19 where is trapped or otherwise disposed of.

Figure 2:
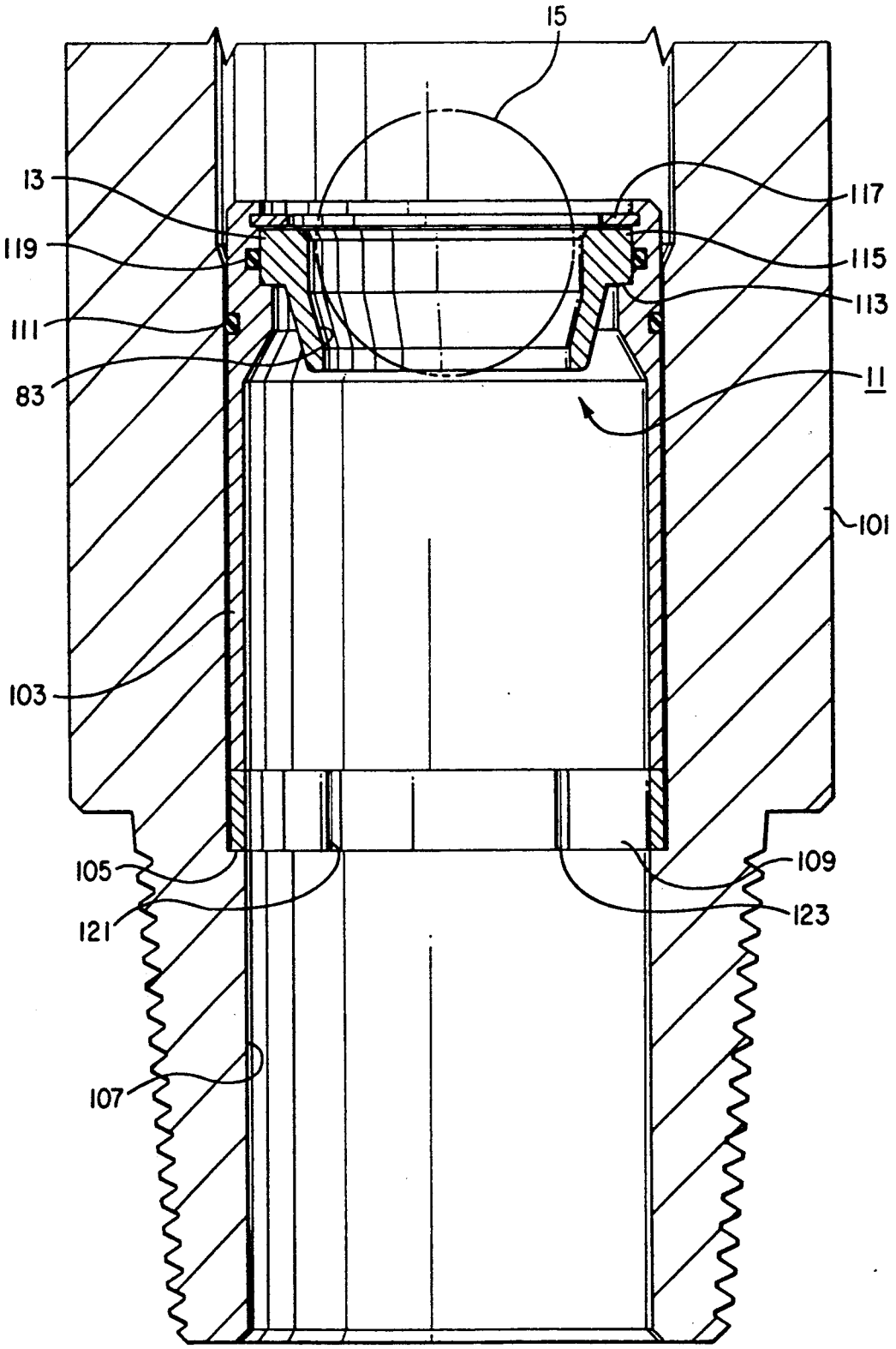
FIG. 2 is a longitudinal section view of one preferred embodiment of the seal means of the present invention equipped with a plug trap mechanism, in one particular application of communicating messages through the wellbore fluid.

FIG. 2 is a longitudinal section view of one preferred embodiment of the seal means of the present invention, equipped with a plug trap mechanism, and in one particular application of communicating messages through the wellbore fluid. Seal assembly 11 is shown disposed in the pin end of wellbore tubular member 101. As shown, seal mandrel 103 is adapted to abut internal shoulder 105 of central bore 107 of tubular member 101. Seal mandrel 103 is sealed at an interface with wellbore tubular member 101 by operation of O-ring seal 111. Internal shoulder 113 is provided in seal mandrel 103, and is adapted for receiving external shoulder 115 of valve seat 113. Valve seat 13 is held in place relative to seal mandrel 103 by snap ring 117, and is sealed at the interface with seal mandrel 103 by operation of O-ring 119.

As shown, valve seat 113 receives valve plug 15, and substantially occludes the passage of wellbore fluid within central bore 107 of wellbore tubular member 101. As described above, sealing lip 83 will form a seal with valve plug 15, until a predetermined pressure level is developed upstream within central bore 107. Once the predetermined pressure level is achieved, valve plug 15 is urged through valve seat 13, and deforms the yieldable material which forms sealing lip 83 from a first position to a larger-diameter second position. Of course, valve plug 15 drops downward within seal mandrel 103, and is trapped by plug trap 109, which includes a plurality of fluid channels 121, 123.

Figure 7:
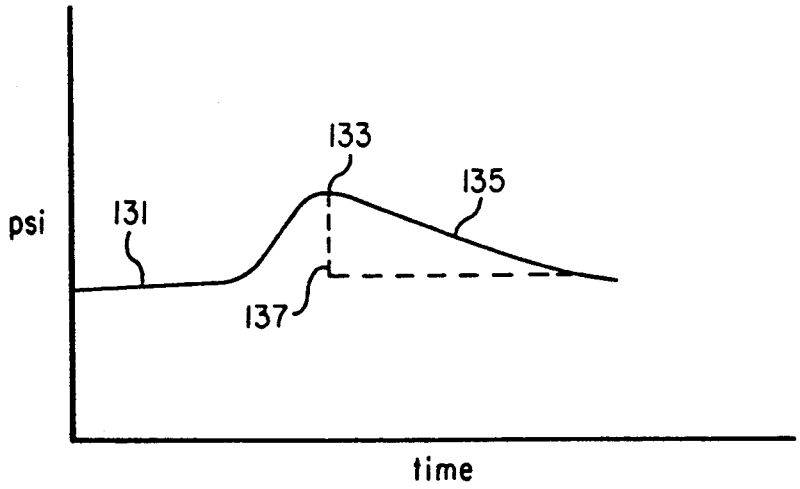
FIG. 7 is a graph of the fluid pressure, in pounds per square inch versus time.

In the configuration of FIG. 2, seal assembly 11 is especially suited for communicating data within a wellbore by developing a definable pressure profile at a given location over a selected time interval. FIG. 7 is a graph of the fluid pressure, in pounds per square inch, developed upstream of valve plug 15, verses time. As shown, prior to seating of valve plug 15 against valve seat 13, the pressure within wellbore tubular member 101 is at a baseline value 131. After seating of valve plug 15 against valve seat 13, the pressure upstream of the seal assembly 11 develops to a pressure maximum 133, which is the predetermined pressure value at which valve plug 15 begins passing through valve seat 13. Thereafter, the pressure upstream of seal assembly 11 gradually declines as graphically depicted by decline curve portion 135. As depicted, there is a substantially smooth transition back down to the baseline pressure value 131. This stands in sharp contrast with prior art wellbore valving which usually includes a sharp drop from a maximum value down to a baseline, which is depicted by the dashed prior art response curve 137. The difference between the prior art response curve 137 and the gradual decline curve 135 is that a substantial "water cannon effect" is avoided with the present invention. The force of a sharp transition in pressure can damage wellbore tools, and hurl unsecured objects in a dangerous and destructive manner.

Prior art valve systems have been developed to provide "bleed valving" which softens the water cannon effect of valving in a wellbore. For example, see U.S. Pat. No. 4,292,988, entitled *Soft Shock Pressure Plug*, which issued to James W. Montgomery, on Oct. 6, 1981.

The present invention operates to vent fluid across valve seat 13 while sealing lip 83 maintains engagement of valve plug 15, to facilitate a gradual transition of fluid pressure at valve seat 13. This bleed valve effect can perhaps be best described with reference to FIG. 6. When valve plug 15 is positioned to seal against sealing lip 83 at seal point 93 (which is really a seal line) the force at seal point 93 is a combination of the burst force, frictional contact between valve plug 15 and valve seat 13, and deformation of sealing lip 83. However, as file plug 15 progressed downward, deforming valve seat 13, energy is absorbed in the deformation of valve seat 13, and in the frictional contact between valve plug 15, and valve seat 13. When valve plug 15 progresses to straightaway region 95, the force acting on valve seat 13 is a combination of the frictional losses as valve plug 15 drags along valve seat 13, and the force expended in deforming valve seat 14 by urging it radially outward.

Figure 3A:
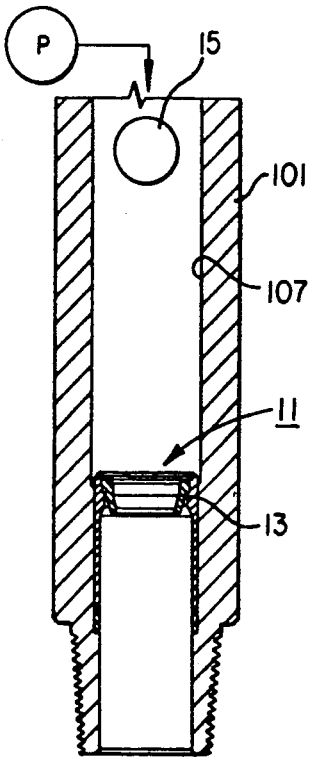
FIGS. 3*a*, 3*b*, and 3*c* depict in successive stop-action time sequence order the placement, seating, and release of a first wellbore plug relative to a wellbore seat.
Figure 3B:
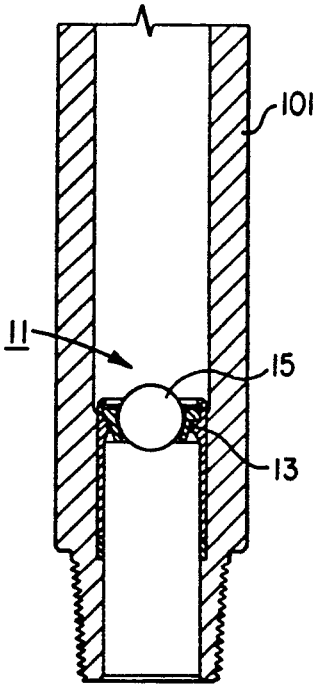
Figure 3C:
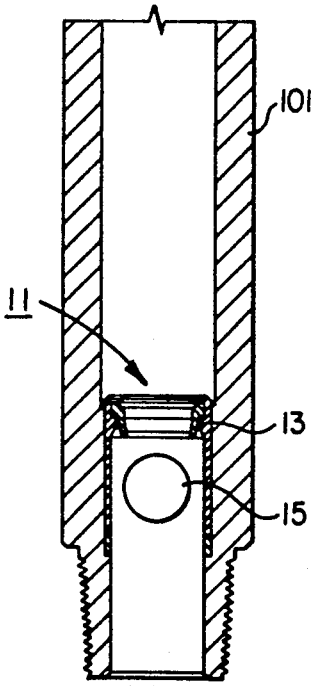
Figure 4A:
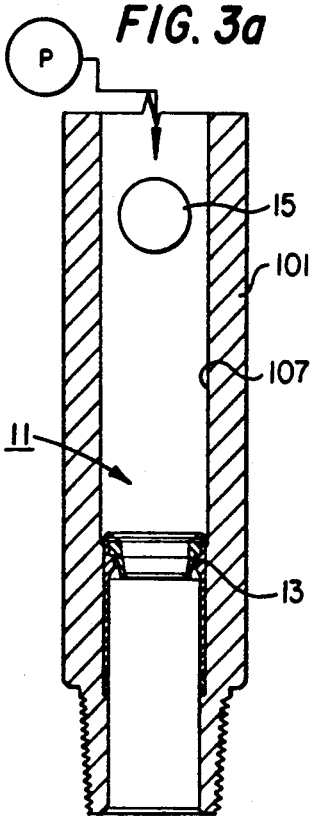
FIGS. 4*a*, 4*b*, and 4*c* depict in successive stop-action time sequence order the placement, seating, and release of a second, larger wellbore plug relative to a wellbore seat.
Figure 4B:
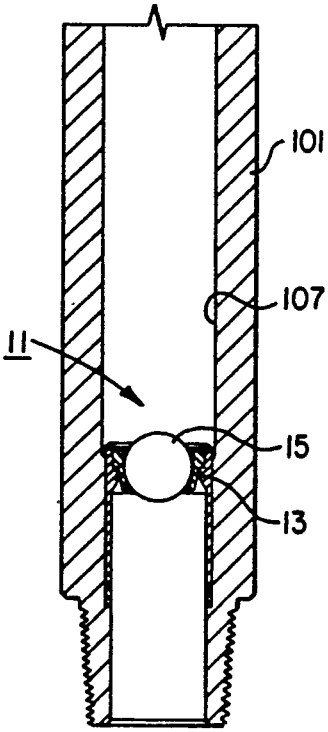
Figure 4C:
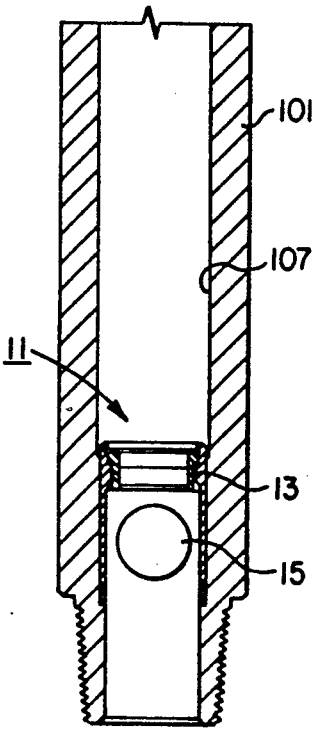

FIGS. 3 and 4 show the successive seating of progressively larger valve plugs 15 with valve seat 13. Beginning with FIG. 3*a*, valve plug 15 having a plugging dimension of P1 is dropped within central bore 107 of wellbore tubular member 101. As shown in FIG. 3*b*, valve plug 15 sealingly engages valve seat 13, and pressure is developed up stream of seal assembly 11. Once an empirically determined predetermined pressure threshold is exceeded, valve plug 15 will operate to deform the yieldable material which forms sealing lip 83 of valve seat 13, and will pass therethrough As shown in FIG. 4*a*, a second valve plug 15 is dropped within central bore 107 of wellbore tubular member 101, which has a slightly larger plugging dimension than the previous valve plug 15. Of course, valve seat 13 of seal assembly 11 now a slightly expanded sealing lip 83. As shown in FIG. 4*b*, valve plug 15 sealingly engages valve seat 13, and a pressure differential is developed across valve assembly 11, until a predetermined pressure level is obtained. Upon obtaining the predetermined pressure differential, valve plug 15 deforms sealing lip 83 of valve seat 13, and then passes therethrough.

When viewed broadly, valve seat 13 is operable in a plurality of modes. In a receiving mode of operation, valve seat 13 allows the passage of selected plug members which have a sufficiently small plugging dimension to pass therethrough without sealingly engaging sealing lip 83. Therefore, very small valve plugs 15 may be passed through valve seat 13, and may sealingly engage other, smaller valve seats disposed downward within wellbore tubular member 101. Of course, valve seat 13 prevents the passage of plug members which have a plugging dimension equal to or greater than the sealing dimension of valve seat 13.

During a sealing mode of operation, valve seat 13 mates with a selected plug member, which has a plugging dimension equal to or greater than the seating dimension of valve seat 13. Of course, sealing assembly 11 operates to substantially occlude central bore 107 of wellbore tubular member 101 to obstruct passage of fluid therethrough, creating a pressure differential across valve seat 13.

In a releasing mode of operation, the yieldable material of valve seat 13 deforms in response to elevation of the pressure differential above a predetermined release pressure level, altering the sealing dimension of valve seat 13, and allowing the valve plug to pass therethrough. Valve seat 13 may successively and sequentially mate with a plurality of plug members to cause successive deformation of valve seat 13, and sequentially and successively alter the seating dimension of valve seat 13. This allows valve seat 13 to successively and selectively mate with selected valve plugs 15.

Figure 8:
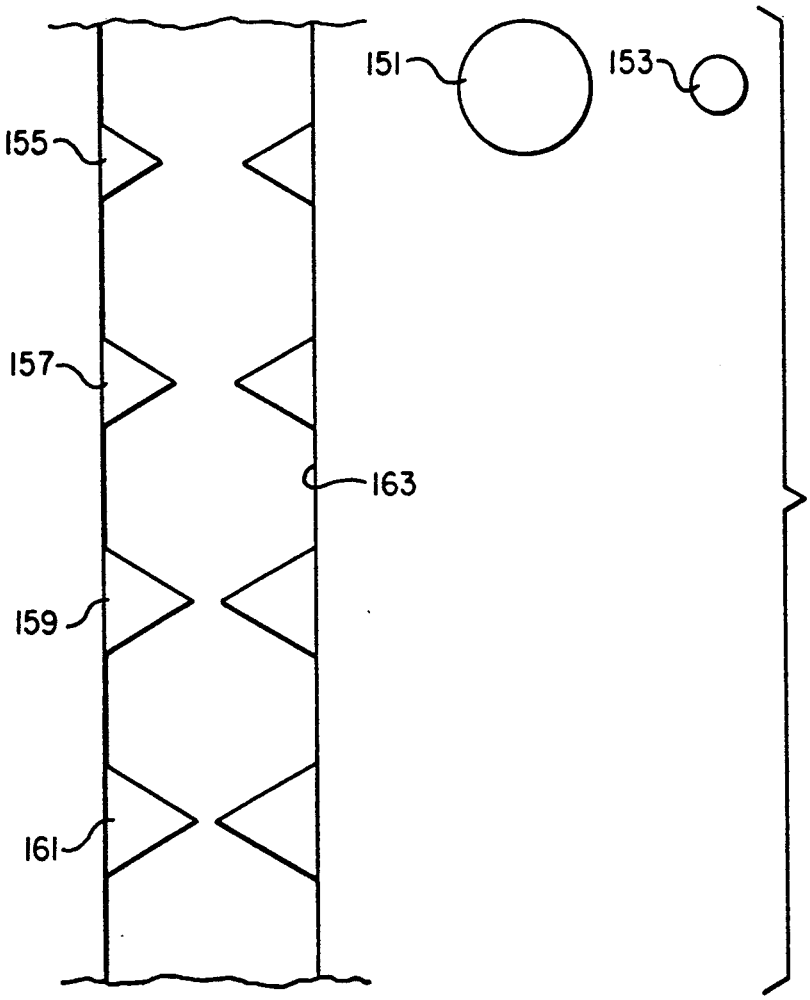
FIG. 8 is a schematic view of a wellbore tubular member equipped with a plurality of valve seats, and adapted for sequentially receiving valve plugs having differing plugging dimensions.

One example of the use of multiple valve seats and valve plugs is shown schematically in FIG. 8. Valve plugs 151, 153 have differing plugging dimensions. Wellbore tubular member 163 is equipped with a plurality of valve seats 155, 157, 159, and 161. As shown, valve plug 153 will pass with these through valve seats 155, 157, without sealingly engaging valve seats 155, 157. However, valve plug 153 will sealingly engage valve seats 159, 161.

Valve plug 151 is adapted to sealingly engage valve seats 155, 157. In operation, valve plug 153 can be passed downwardly through valve seats 155, 157, to successively sealingly engage valve seats 159, 161. Thereafter, valve plug 151 can be passed downward to successively sealingly engage valve seats 155, 157, 159, and 161. Additional valve seats and plugs can be provided which have still different sealing and plugging dimensions, to allow for the successive sequential actuation of fluid pressure actuated wellbore tools which are carried by wellbore tubular member 163. For example, the pressure levels obtained by the successive and sequential sealing of valve plugs 151, 153 against valve seats 155, 157, 159, and 161 can serve to sequentially actuate wellbore tools, such as valves, packers, and perforating equipment.

In short, the present invention allows for a flexible mechanism for controlling the sequential operation of wellbore tools by dropping a sequence of valve plugs having different plugging dimensions downward in the wellbore.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A valve seat, adapted for receiving a valve plug having a plugging dimension, for use in a fluid conduit having an inner wall disposed about a central longitudinal axis, said inner wall defining a central bore for passage of fluid from an upstream location to a downstream location, comprising:

an anchor section axially aligned with said central longitudinal axis of said fluid conduit defining a first clearance within said central bore greater than said plugging dimension of said valve plug to allow passage of said valve plug through said central bore of said fluid conduit past said anchor section;

a sealing lip coupled to said anchor section in a first position relative to said anchor section and defining a second clearance within said fluid conduit which is smaller than said plugging dimension, said sealing lip including a seating surface which at least in-part defines said second clearance, for sealingly engaging said valve plug and substantially occluding passage of said fluid from said upstream location to said downstream location;

wherein a pressure differential is developed across said valve seat when said valve plug sealingly engages said seating surface, applying force to said sealing lip;

said sealing lip being formed of a yieldable material which deforms to expand said second clearance to said plugging dimension to allow passage to said valve plug downstream within said fluid conduit when a predetermined amount of force is applied thereto through said valve plug;

wherein after passage of said valve plug, said seating surface of said seating lip is disposed in a second position relative to said anchor section defining a third clearance intermediate said first and second clearances.

2. A valve seat according to claim 1, wherein said anchor section is in abutting contact with said inner wall of said fluid conduit.

3. A valve seat according to claim 1, wherein said first clearance is disposed radially inward from said anchor section.

4. A valve seat according to claim 1, wherein said second clearance is disposed radially inward from said seating surface.

5. A valve seat according to claim 1, wherein said anchor section comprises a circular anchor section concentric with said fluid conduit.

6. A valve seat according to claim 1, wherein said anchor section comprises a circular anchor section concentric with said fluid conduit and in abutting contact therewith.

7. A valve seat according to claim 1, wherein said sealing lip comprises a circular member concentric with said fluid conduit, and which defines a circular clearance also concentric with said fluid conduit.

8. A valve seat according to claim 1, wherein said anchor section defines a shoulder piece for abutment with a reciprocally-shaped shoulder carried in said central bore of said fluid conduit to prevent axial movement of said anchor section.

9. A valve seat according to claim 1, wherein said seating lip is integrally formed with said anchor section.

10. A valve seat according to claim 1, wherein said seating lip extends downward from said anchor section, and radially inward from said anchor section.

11. A valve seat according to claim 1, wherein said seating surface is disposed at a selected angle relative to said inner wall, and wherein passage of said valve plug alters the angular disposition of said seating surface relative to said inner wall.

12. A seal means for use in a wellbore tubular member disposed in a subterranean wellbore, said wellbore tubular member having a bore which serves as a conduit for passing wellbore fluids, comprising:

a plug member positionable within said bore of said tubular member;

a seat member disposed within said bore and coupled to said wellbore tubular member, said seat member having first and second ends, said first end for receiving said plug member;

said seat member and said plug member cooperating together to substantially occlude said bore of said wellbore tubular member and impede the passage of wellbore fluids through said bore, to develop a pressure differential between said first and second ends of said seat member, causing said plug member to sealingly engage said seat member;.

said seat member including at least one yieldable region formed from expandable material which allows said seat member to hold said plug member in sealing engagement up to a preselected pressure differential level; and wherein development of a pressure differential between said first and second ends of said seat member to an amount above said preselected pressure differential level causes said expandable material to deform and said at least one yieldable region of said seat member to expand to allow passage of said plug member through said seat member to exit from said second end of said seat member.

13. A seal means according to claim 12, wherein said plug member comprises a spherical-shaped ball, and wherein said seat member includes a circular-shaped seat region for mating with said plug member.

14. A seal means according to claim 12, wherein said bore of said wellbore tubular member comprises a central bore extending axially through said wellbore tubular member.

15. A seal means according to claim 12, wherein said plug member comprises a spherical-shaped ball which is positionable within said bore of said tubular member.

16. A seal means according to claim 12, wherein said plug member has a selected specific gravity which is greater than that of said wellbore fluid and is positionable within said wellbore by falling within said wellbore fluid.

17. A seal means according to claim 12, further including means for trapping said plug, disposed adjacent said second end of said seat member.

18. A seal means according to claim 12, further comprising:

means for maintaining said seat member in a fixed position within said wellbore tubular member, which shifts axially relative to said wellbore tubular member at a preselected pressure differential between said first and second ends of said seat member.

19. A seal means for use in a wellbore tubular member disposed in a subterranean wellbore, said wellbore tubular member having a bore which serves as a conduit for passing wellbore fluids of a determinable specific gravity, comprising:

a plurality of plug members, each having a selected specific gravity relative to said specific gravity of said wellbore fluids, for passage within said wellbore through said wellbore fluid, each having a selected plugging dimension which differs from said plugging dimension of others of said plurality of plug members;

a seat member disposed within said bore of said wellbore tubular member and including a seating surface means for receiving selected ones of said plurality of plug members and defining an exhaust passage through said seat member, said seating surface means being composed of a yieldable material and defining a sealing dimension, said seat member being operable in a plurality of modes, including:

a receiving mode, wherein said seating member allows passage of selected ones of said plurality of plug members which have a plugging dimension less than said seating dimension of said seating surface means, and prevents passage of others of said plurality of plug members which have a plugging dimension equal to or greater than said seating dimension of said seating surface means;

a sealing mode, wherein said seat member mates with a selected one of said plurality of plug members which has a plugging dimension equal to or greater than said seating dimension, wherein said selected one of said plurality of plug members sealingly engages said seating surface means to substantially occlude said bore of said wellbore tubular member to obstruct passage of fluid therethrough, creating a pressure differential across said seat member;

a releasing mode, wherein said yieldable material of said seating surface means deforms in response to elevation of said pressure differential above a predetermined release pressure level, altering said sealing dimension of said seating surface means and allowing said selected one of said plurality of plug members to pass through said exhaust passage; and wherein successive operation in receiving, sealing and releasing modes of operation for said plurality of plug members causes successive deformation of said seating surface means and alters said seating dimension, allowing said seat member to successively and selectively mate with selected ones of said plurality of plug members.

20. A seal means according to claim 19, wherein said plurality of plug members comprises a plurality of sphere-shaped plugs formed of a material having a specific gravity greater than said specific gravity of said wellbore fluids which allow said plurality of sphere-shaped plugs to be dropped within said wellbore tubular member.

21. A seal means according to claim 19, wherein said plurality of plug members comprises a plurality of sphere-shaped plugs formed of a material having a specific gravity greater than said specific gravity of said wellbore fluids which allow said plurality of sphere-shaped plugs to be dropped within said wellbore tubular member, and wherein said plurality of sphere-shaped plugs having diameters which define said plugging dimensions.

22. A seal means according to claim 19, wherein said plurality of plug members comprises a plurality of sphere-shaped plugs formed of a material having a specific gravity greater than said specific gravity of said wellbore fluids which allow said plurality of sphere-shaped plugs to be dropped within said wellbore tubular member, and wherein said seat member includes a seating surface which comprises a circular seating surface with a sealing lip formed of yieldable material and disposed radially inward a selected distance from said wellbore tubular member, radially bounding and defining a central exhaust passage.

23. A seal means according to claim 19, wherein said plurality of plug members comprises a plurality of sphere-shaped plugs formed of a material having a specific gravity greater than said specific gravity of said wellbore fluids which allow said plurality of sphere-shaped plugs to be dropped within said wellbore tubular member, and wherein operation of said seal means in said release mode of operation causes said sealing lip to deform radially outward simultaneously placing said sealing lip closer in proximity to said wellbore tubular member and enlarging said central exhaust passage.

24. A seal means according to claim 19, further comprising:

at least one additional seat member disposed within said bore of said wellbore tubular member in axial alignment with said seat member and including a seating surface means for defining at least one additional seating surface for sealingly engaging selected ones of said plurality of plug members.

25. A method of sealing a central bore of a wellbore tubular member to temporarily prevent passage of fluid from an upstream location to a downstream location, comprising:

providing a deformable valve seat which defines a seat clearance within said wellbore tubular member;

providing a first valve plug having a first plugging dimension, which exceeds said seat clearance of said deformable valve seat;

seating said first valve plug against said deformable valve seat;

developing, with said fluid, a pressure differential across said deformable valve seat; and deforming said deformable valve seat at a preselected pressure differential level to irreversibly expand said deformable valve seat clearance and allow passage of said first valve plug through said deformable valve seat.

26. A method of sealing according to claim 25, further comprising:

providing a second valve plug having a second plugging dimension greater than said first plugging dimension;

seating said second valve plug against said deformable valve seat;

developing, with said fluid, a pressure differential across said deformable valve seat; and deforming said valve seat at a preselected pressure differential level to further irreversibly expand said deformable valve seat clearance to allow passage of said second valve plug through said deformable valve seat.

27. A method of sealing according to claim 25, further comprising:

providing at least one additional valve plug, which together with said first valve plug constitute a plurality of valve plugs having plugging dimensions over a selected range of plugging dimensions;

successively seating said plurality of valve plugs against said deformable valve seat;

successively developing, with said fluid, pressure differentials across said deformable valve seat;

successively deforming said deformable valve seat at preselected pressure differential levels to successively and irreversibly expand said deformable valve seat clearance to allow sequential passage of said plurality of valve plugs through said deformable valve seat.

28. A method of sealing according to claim 25, further comprising:

providing at least one additional valve plug, which together with said first valve plug constitute a plurality of valve plugs, including a first subset which have plugging dimensions less than said seat clearance of said deformable valve seat, and a second subset which have plugging dimensions greater than said seat clearance over a selected range of plugging dimensions;

selectively passing selected ones of said first subset of said plurality of valve plugs through said deformable valve seat;

successively and selectively seating selected ones of said second subset of said plurality of valve plugs against said deformable valve seat;

successively developing, with said fluid, pressure differentials across said deformable valve seat; and successively deforming said deformable valve seat at preselected pressure differential levels to successively and irreversibly expand said deformable valve seat clearance to allow sequential passage of selected ones of said plurality of valve plugs through said deformable valve seat.

29. A method of sealing according to claim 25, further comprising:

providing at least one additional deformable valve seat, which together with said first valve seat constitute a plurality of deformable valve seats, wherein each of said plurality of valve seats additionally define a selected seat clearance within said wellbore tubular member, over a selected range of seat clearances;

providing at least one additional valve plug, which together with said first valve plug constitute a plurality of valve plugs which have plugging dimensions over a selected range of plugging dimensions;

selectively and successively seating selected ones of said plurality of valve plugs against selected ones of said plurality of deformable valve seats;

sequentially developing, with said fluid, a plurality of selected pressure differentials across selected ones of said plurality of deformable valve seats; and selectively deforming selected ones of said plurality of deformable valve seats at preselected pressure differential levels to irreversibly expand said selected ones of said plurality of deformable valve seat clearances to allow passage of selected ones of said plurality of valve plugs therethrough.

30. A valve seat, adapted for receiving a valve plug having a plugging dimension, for use in a fluid conduit having an inner wall disposed about a central longitudinal axis, said inner wall defining a central bore for passage of fluid from an upstream location to a downstream location, comprising:

an anchor section axially aligned with said central longitudinal axis of said fluid conduit defining a first clearance within said central bore greater than said plugging dimension of said valve plug to allow passage of said valve plug through said central bore of said fluid conduit past said anchor section;

a sealing lip, formed of a yieldable material which deforms to expand when a predetermined amount of force is applied thereto, coupled to said anchor section and defining a second clearance within said fluid conduit which is smaller than said plugging dimension of said valve plug, said sealing lip including:

a seating surface which at least in-part defines said second clearance, for sealing engaging said valve plug at a seal point over a range of positions as said valve plug is advanced relative to said sealing lip; and an engagement surface located downstream from said seating surface for frictionally engaging said valve plug;

wherein a pressure differential is developed across said valve seat when said valve plug sealingly engages said seating surface, applying force to said sealing lip;

wherein, when said force exceeds said predetermined amount necessary to deform said sealing lip, said valve plug advances in position along said seating surface as said yieldable material deforms and said second clearance is altered, and thereafter, said valve plug traverses and frictionally engages said engagement surface until said valve plug exits said valve seat.

31. A valve seat according to claim 30, wherein as said valve plug traverses and frictionally engages said engagement surface, fluid is bled through said valve seat.

32. A valve seat according to claim 30, wherein said seating surface comprises a cylindrical surface inclined at a selected angle relative to said inner wall of said fluid conduit.

33. A valve seat according to claim 30, wherein said engagement surface comprises a cylindrical sleeve parallel with said inner wall of said fluid conduit.

34. A valve seat according to claim 30, wherein said seating surface and said engagement surface are integrally formed.

35. A valve seat according to claim 30, wherein said seating surface is formed of a yieldable material which is deformable in an amount not exceeding a predetermined yield percentage, and wherein said plugging dimension of said valve plug differs from said first clearance by an amount not exceeding said yield percentage.

36. A valve seat, adapted for receiving a valve plug having a plugging dimension, for use in a fluid conduit having an inner wall disposed about a central longitudinal axis, said inner wall defining a central bore for passage of fluid from an upstream location to a downstream location, comprising:

an anchor section axially aligned with said central longitudinal axis of said fluid conduit defining a first clearance within said central bore greater than said plugging dimension of said valve plug to allow passage of said valve plug through said central bore of said fluid conduit past said anchor section;

a sealing lip, formed of a yieldable material which deforms to expand when a predetermined amount of force is applied thereto, coupled to said anchor section and defining a second clearance within said fluid conduct which is smaller than said plugging dimension of said valve plug, said sealing lip including:

a seating surface which at least in-part defines said second clearance, for sealingly enagaging said valve plug at a seal point over a range of positions as said valve plug is advanced relative to said sealing lip; and bleed valve means for venting fluid across said valve seat while said sealing lip maintains engagement of said valve plug to facilitate a gradual transition of fluid pressure at said valve seat;

wherein a pressure differential is developed across said valve seat when said valve plug sealingly engages said seating surface, applying force to said sealing lip; and wherein, when said force exceeds said predetermined amount necessary to deform said sealing lip, said valve plug advances in position along said seating surface as said yieldable material deforms, and said bleed valve means vents fluid across said valve seat to facilitate a gradual transition of fluid pressure at said valve seat.

* * * * *

UNITED STATES PATENT AND TRADEMARK OFFICE

CERTIFICATE OF CORRECTION

PATENT NO. : 5,146,992

DATED : September 15, 1992

INVENTOR(S) : John L. Baugh

It is certified that error appears in the above-identified patent and that said Letters Patent is hereby corrected as shown below:

TITLE PAGE, ITEM [57], ABSTRACT:

At line 9, "plug" should be inserted between "valve" and "deforms".

At column 1, line 62, "a" should be inserted between "and" and "seat";
at column 4, line14, "," should be inserted between "sheared" and "seal";
at column 4, line 51, delete "retaining" and insert "retainer" in its place;
at column 4, line 60, delete "with" and insert "within" in its place;
at column 4, line 68, delete "comprise" and insert "comprises" in its place;
at column 8, line 38, insert "." at the end of the sentence;
at column 8, line 43, insert "includes" between "now" and "a";
at column 11, line 7, delete "." at the end of the sentence;
at column 15, line 12, insert "," between "and" and "thereafter".

At column 6, line 2, replace "tabular" with "tubular";
at column 16, line 14, replace "conduct" with "conduit".

Signed and Sealed this

Nineteenth Day of April, 1994

*Attest:*

Bruce Lehman

BRUCE LEHMAN

*Attesting Officer*

*Commissioner of Patents and Trademarks*